US007094101B1

(12) United States Patent
Noro et al.

(10) Patent No.: US 7,094,101 B1
(45) Date of Patent: Aug. 22, 2006

(54) TERMINAL FITTING

(75) Inventors: Yutaka Noro, Yokkaichi (JP); Ryotaro Ishikawa, Yokkaichi (JP); Hajime Kawase, Yokkaichi (JP); Takahiro Yoneda, Sagamihara (JP); Ryo Sawada, Kawasaki (JP); Ken Yoshimura, Torrance, CA (US)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 11/344,758

(22) Filed: Feb. 1, 2006

(30) Foreign Application Priority Data

Feb. 2, 2005 (JP) ..... 2005-026565

(51) Int. Cl.
*H01R 13/40* (2006.01)

(52) U.S. Cl. ..... 439/595; 439/752; 439/748

(58) Field of Classification Search ..... 439/595, 439/748, 752

See application file for complete search history.

(56) References Cited

U.S. PATENT DOCUMENTS

| | | | | |
|---|---|---|---|---|
| 5,235,743 | A | 8/1993 | Endo et al. | |
| 6,280,250 | B1 * | 8/2001 | Ko | 439/595 |
| 6,375,502 | B1 * | 4/2002 | Yoshida et al. | 439/595 |
| 6,626,702 | B1 * | 9/2003 | Kurimoto et al. | 439/595 |

* cited by examiner

*Primary Examiner*—Truc Nguyen
(74) *Attorney, Agent, or Firm*—Gerald E. Hespos; Anthony J. Casella

(57) ABSTRACT

A terminal fitting (T) has a rectangular tube (10). A resilient locking piece (25) is accommodated in a rectangular tube portion (10) and a locking hole (19) in the tube (10) exposes the resilient locking piece (25). A side plate (13R) of the rectangular tube (10) is provided with an intrusion restricting portion (21) near the resilient contact piece (25) and in an opening area of the locking hole (19). Thus, the intrusion of an external matter through the locking hole (19) can be restricted by the intrusion restricting portion (21), thereby preventing the interference of the external matter with the resilient contact piece (25).

7 Claims, 11 Drawing Sheets

TERMINAL FITTING

BACKGROUND OF THE INVENTION

1. Field of the Invention

The invention relates to a terminal fitting.

2. Description of the Related Art

U.S. Pat. No. 5,235,743 discloses a terminal fitting with a rectangular tube for receiving a tab of a mating terminal. A resilient contact piece is accommodated in the rectangular tube and is held resiliently in contact with the tab. A locking hole is formed in a plate of the rectangular tube. The terminal fitting is inserted into a cavity of a connector housing and is retained therein by the engagement of the locking hole with a resiliently deformable lock provided at an inner wall of the cavity.

Part of the resilient contact piece can be seen through the locking hole from the outside of the rectangular tube. Thus, external matter can intrude through the locking hole and can deform the resilient contact piece.

The invention was developed in view of the above problem, an object thereof is to prevent the intrusion of external matter into a tube.

SUMMARY OF THE INVENTION

The invention relates to a terminal fitting with a tube for receiving a mating contact portion, such as a tab. A resilient contact piece is accommodated at least partly in the tube and contact with the mating contact portion while being resiliently deformed. A locking hole is formed in a plate of the tube and at least partly exposes the resilient contact piece to the outside of the tube. The locking hole is engageable with a resiliently deformable lock of a connector housing to retain the terminal fitting in the housing. At least one intrusion restricting portion is formed near the resilient contact piece and is located at least partly located in an opening area of the locking hole. The intrusion restricting portion restricts intrusion of external matter through the locking hole, and thus prevents the external matter from interfering with the resilient contact piece.

The intrusion restricting portion preferably is outside a deformation space for the resilient contact piece. Thus, the intrusion restricting portion will not interfere with of the resilient contact piece, and reliable contact between the mating contact portion and the resilient contact piece is assured.

The widthwise center of the resilient contact piece preferably is offset from the widthwise center of the tube. Additionally, the intrusion restricting portion preferably is formed only at a side plate more distant from the resilient contact piece. This offset enables the intrusion restricting portion to utilize a dead space between the resilient contact piece and one side plate, thereby avoiding an enlargement of the terminal fitting.

The locking hole preferably is formed over substantially the entire width of the tube.

End surfaces of lateral sides of the tube preferably are exposed in the opening area of the locking hole.

The intrusion restricting portion preferably is formed by inwardly embossing an end edge of the side plate facing the locking hole. The inward embossing is more easily workable that cutting and bending.

Displacement of the resilient contact piece towards the tube is restricted by bringing a portion of the resilient contact piece into contact with a locking plate or locking recess.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
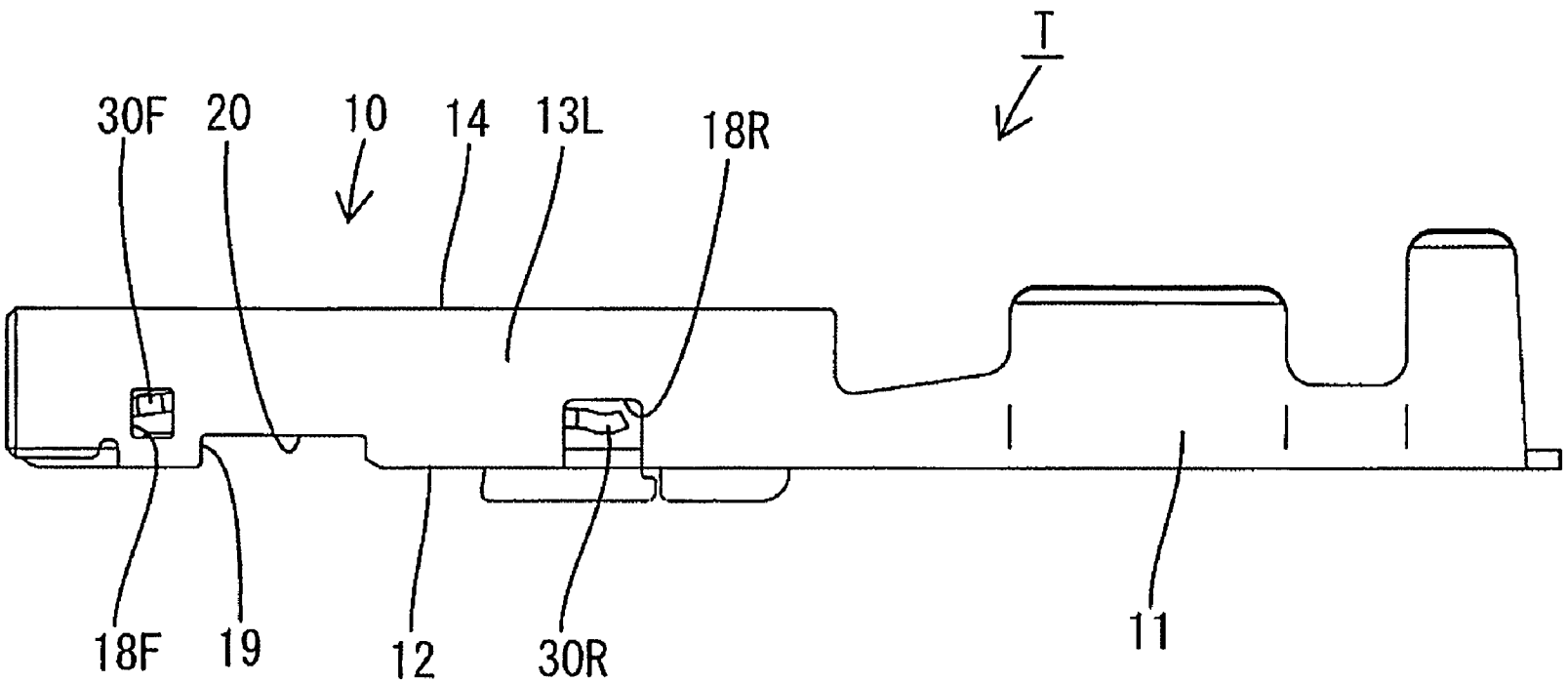
FIG. 1 is a right side view of a terminal fitting according to one embodiment of the invention.
Figure 2:
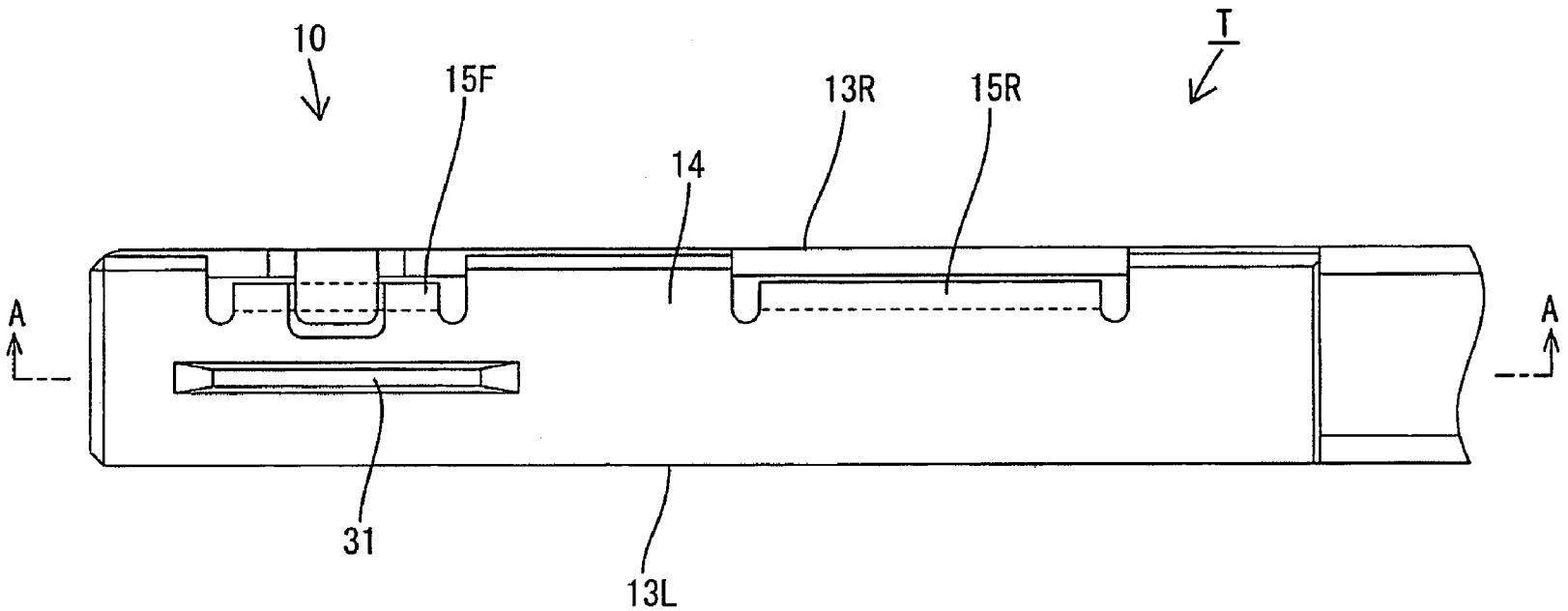
FIG. 2 is a plan view of the terminal fitting.
Figure 3:
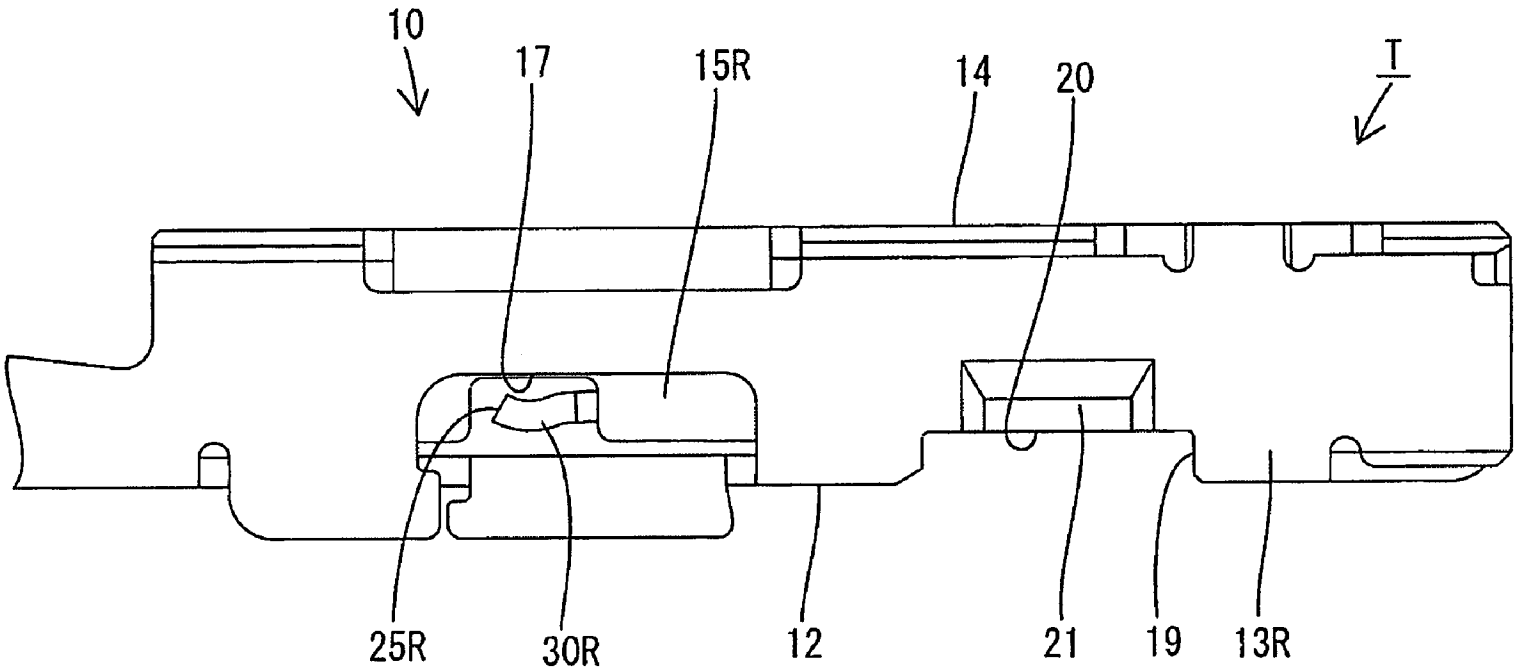
FIG. 3 is a left side view of the terminal fitting.
Figure 4:
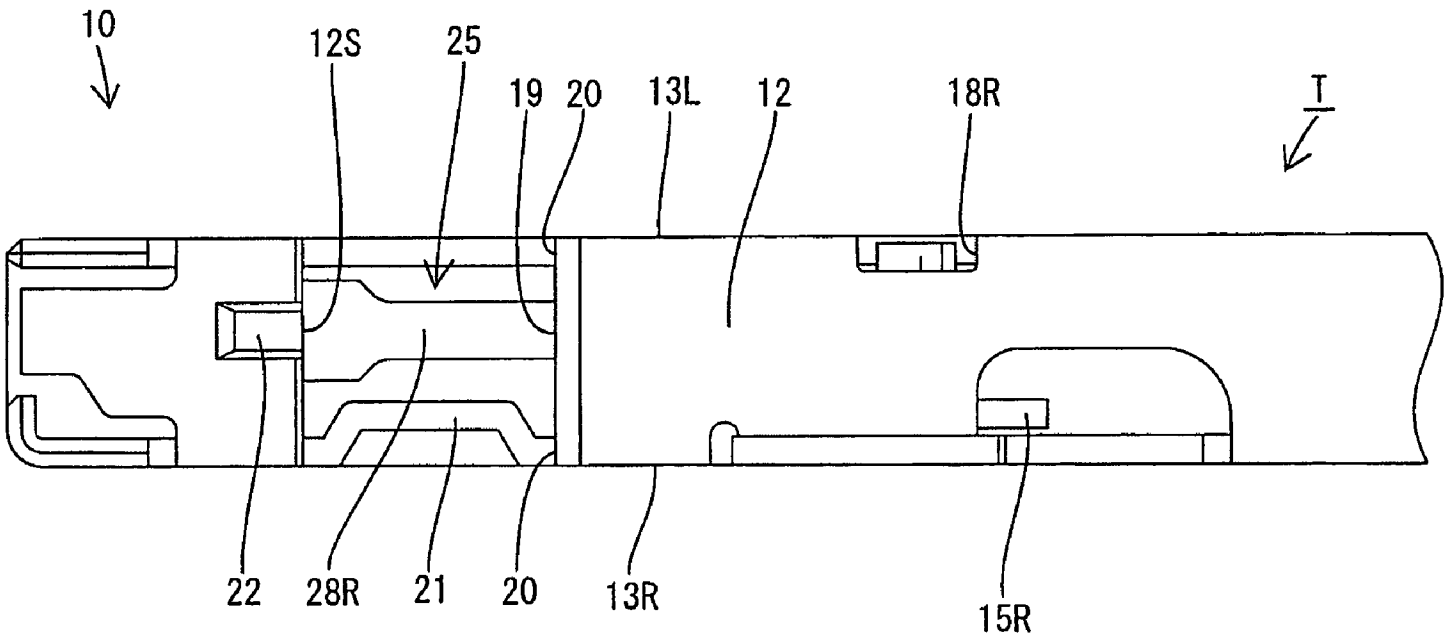
FIG. 4 is a bottom view of the terminal fitting.

A terminal fitting in accordance with the invention is identified by the letter T in FIGS. 1 to 12. Several such terminal fittings T are accommodated in a connector housing 50. The housing 50 is made e.g. of a synthetic resin and cavities 51 penetrate the housing 50 in forward and backward directions. A lock 52 is cantilevered forwardly along the bottom wall of each cavity 51 and a retaining projection 52*a* projects from each lock 52 into the respective cavity 51. A front plate 53 is mounted on the front of the housing 50, and tabs 54 of male terminal fittings in an unillustrated mating connector are inserted from the front through tab insertion openings 55 in the front plate 53 to enter the cavities 51.

Figure 10:
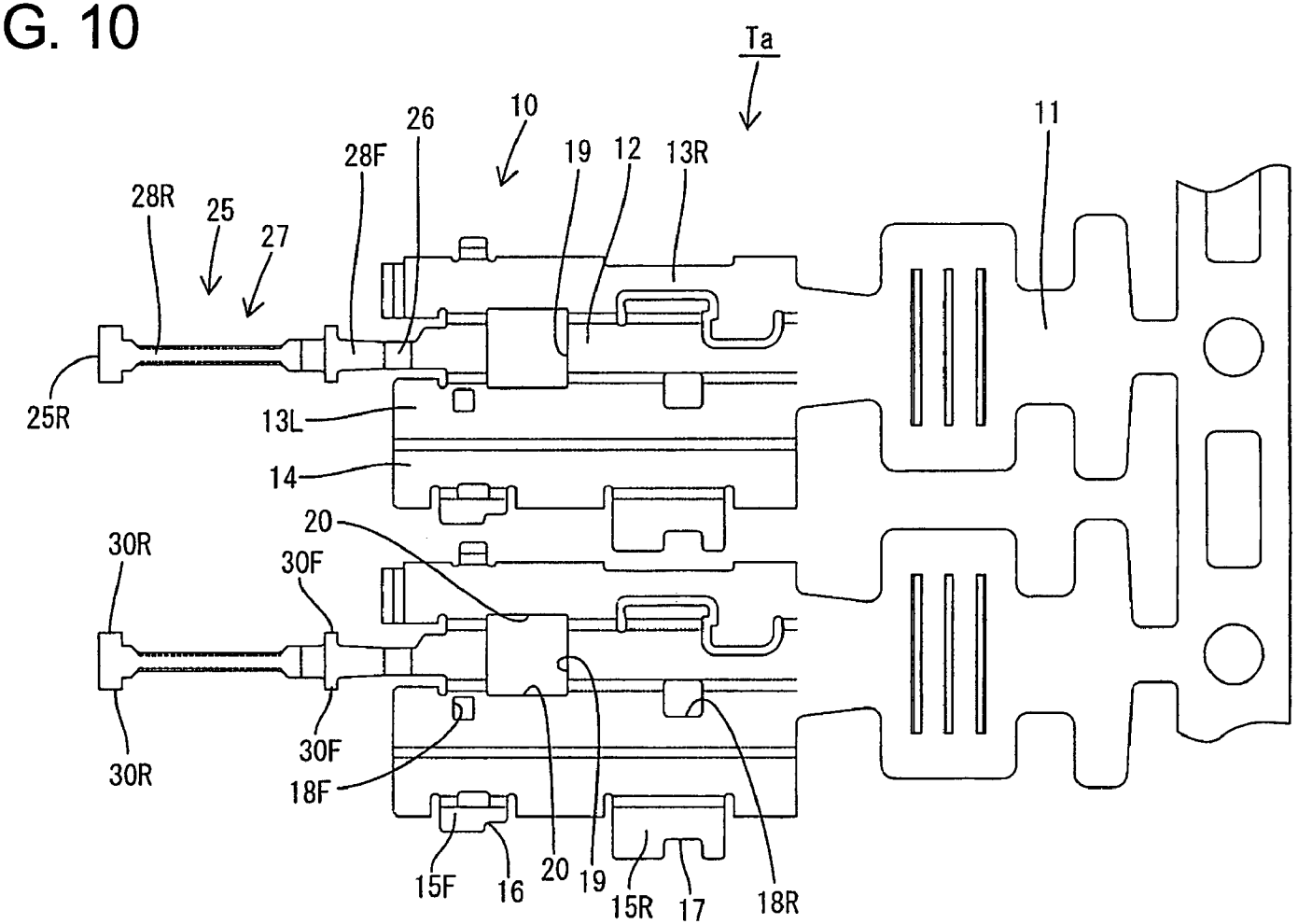
FIG. 10 is a development of the terminal fitting.
Figure 11:
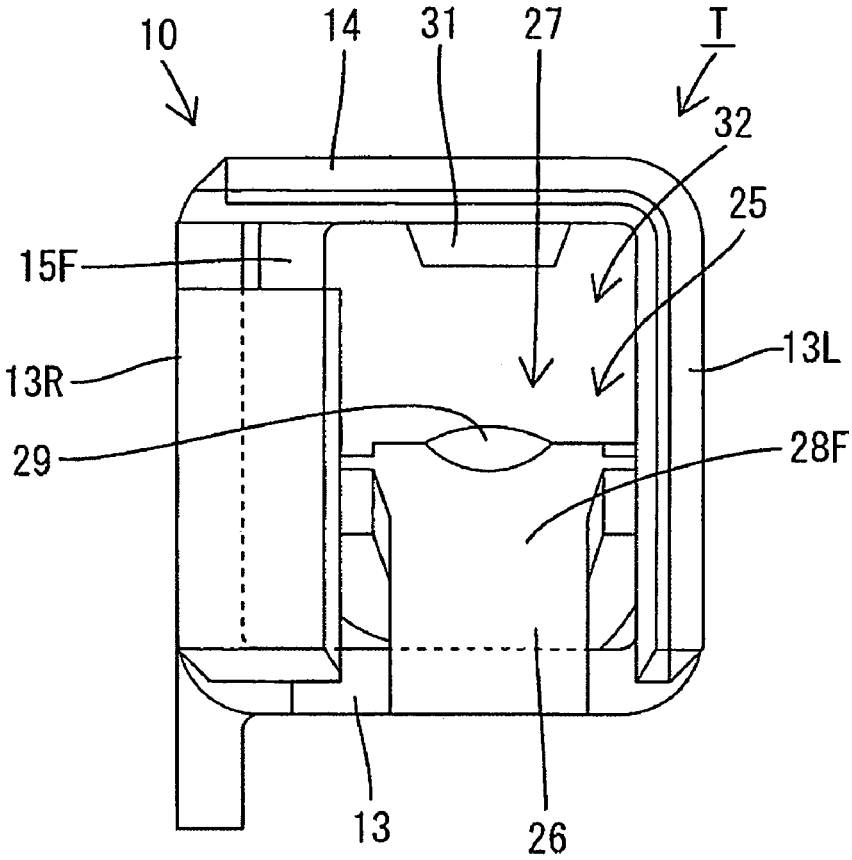
FIG. 11 is a front view of the terminal fitting.
Figure 12:
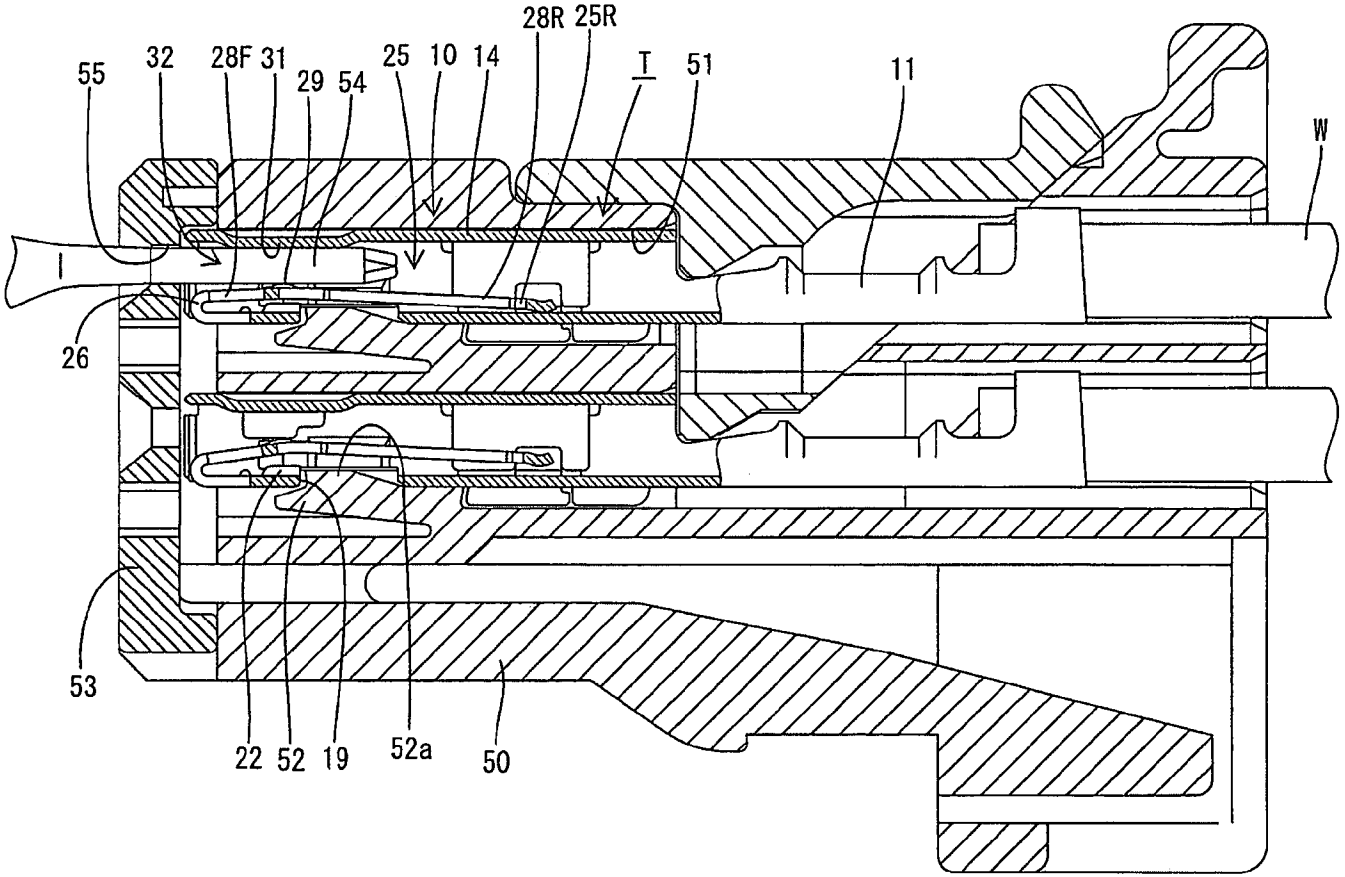
FIG. 12 is a section showing a state where a tab is connected with the terminal fitting.

The terminal fitting T is formed by bending, folding, embossing and/or shaping a conductive metal sheet that has been stamped or cut into a specified shape as shown in FIG. 10. The terminal fitting is substantially long and narrow along forward and backward directions. A tube 10 is formed at the front of the terminal fitting T and a wire connecting portion 11 is formed at the rear of the terminal fitting T. The wire connecting portion 11 has barrels that can be crimped, bent or folded into electrical connection with an end of a wire W.

The tube 10 is substantially rectangular and is hollow along forward and backward directions. More particularly, the rectangular tube 10 has a bottom plate 12 that is substantially long and narrow along forward and backward directions. Left and right side plates 13L, 13R project up at right angles from front areas of the left and right sides of the bottom plate 12, and a ceiling plate 14 extends perpendicularly from substantially the entire top of the left side plate 13L. The ceiling plate 14 projects towards the right side plate 13R and is substantially parallel with the bottom plate 12. Front, rear and intermediate portions of an extending right edge of the ceiling plate 14 contact the upper edge of the right side plate 13R from above. Front and rear locking plates 15F, 15R project down from front and rear positions along the extending edge of the ceiling plate 14 that do not contact the top edge of the right side plate 13R. The front and rear locking plates 15F and 15R extend along front and rear areas of the inner surface of the right side plate 13R. The front locking plate 15F is substantially rectangular (see e.g. FIG. 5) and has a bottom edge at an intermediate height position of the rectangular tube 10. A rear notch 16 is formed towards the rear end of the bottom edge of the front locking plate 15F. The rear locking plate 15R also is substantially rectangular and has a bottom edge that is lower in the rectangular tube portion 10 than the bottom edge of the front locking plate 15F. A bottom notch 17 is formed at an intermediate position of this bottom edge with respect to forward and backward directions. The left side plate 13L is formed with a substantially rectangular front locking hole 18F substantially corresponding to the bottom edge of the front locking plate 15F and a substantially rectangular rear locking hole 18R substantially corresponding to the bottom notch 17 of the rear locking plate 15R.

A substantially rectangular locking hole 19 is formed in the bottom plate 12. Additionally, the bottom edges of the left and right side plates 13L, 13R are cut to a position slightly higher than the upper surface of the bottom plate 12 in areas corresponding to the locking hole 19 with respect to forward and backward directions to form transversely symmetrical side notches 20. Thus, the left and right side plates 13L, 13R have bottom edges in the opening area of the locking hole 19. An area of the bottom part of the right side plate 13R corresponding to the locking hole 19 is embossed to project inward towards the widthwise center, thereby forming an intrusion restricting portion 21. The intrusion restricting portion 21 is substantially rectangular in side view (see e.g. FIG. 3) and is substantially trapezoidal in bottom view (see e.g. FIG. 4). The rear notch 16 of the front locking plate 15F is formed to avoid interference with the front end of the upper edge of the intrusion restricting portion 21.

A retaining portion 22 is formed at the front edge of the locking hole 19. The retaining portion 22 is formed by plastically deforming the opening edge of the locking hole 19 in the bottom plate 12 by stamping or embossing to project up and into the rectangular tube 10. The retaining portion 22 includes an edge 12S of the locking hole 19 that will oppose and engage the retaining projection 52*a* of the lock 52 of the housing 50. The retaining portion 22 is displaced to the left along the width direction relative to the rectangular tube 10. Further, the upper surface of the retaining portion 22 is a substantially flat surface located substantially at the same height as the bottom edges of the side notches 20 and the intrusion restricting portion 21.

Figure 5:
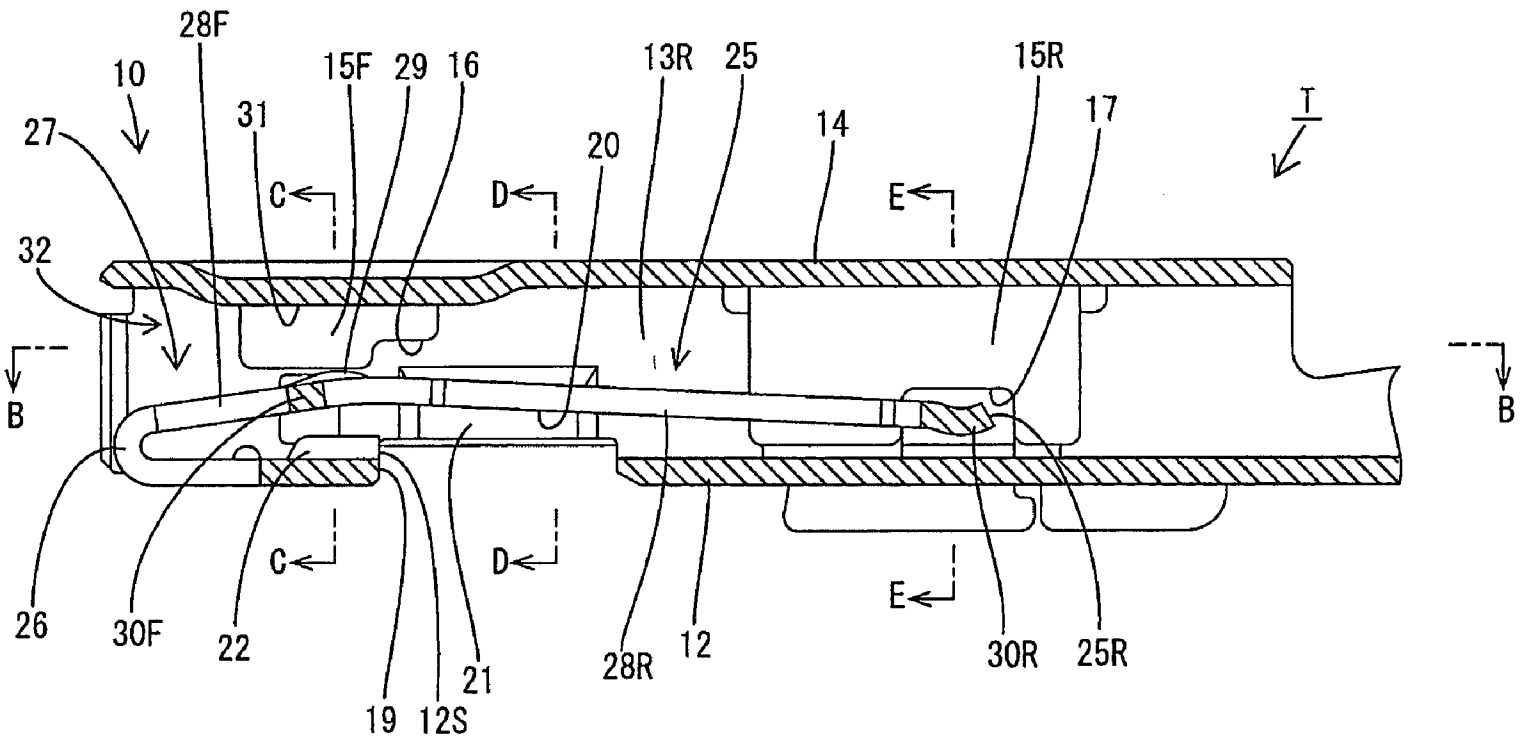
FIG. 5 is a section along 5—5 of FIG. 2.
Figure 6:
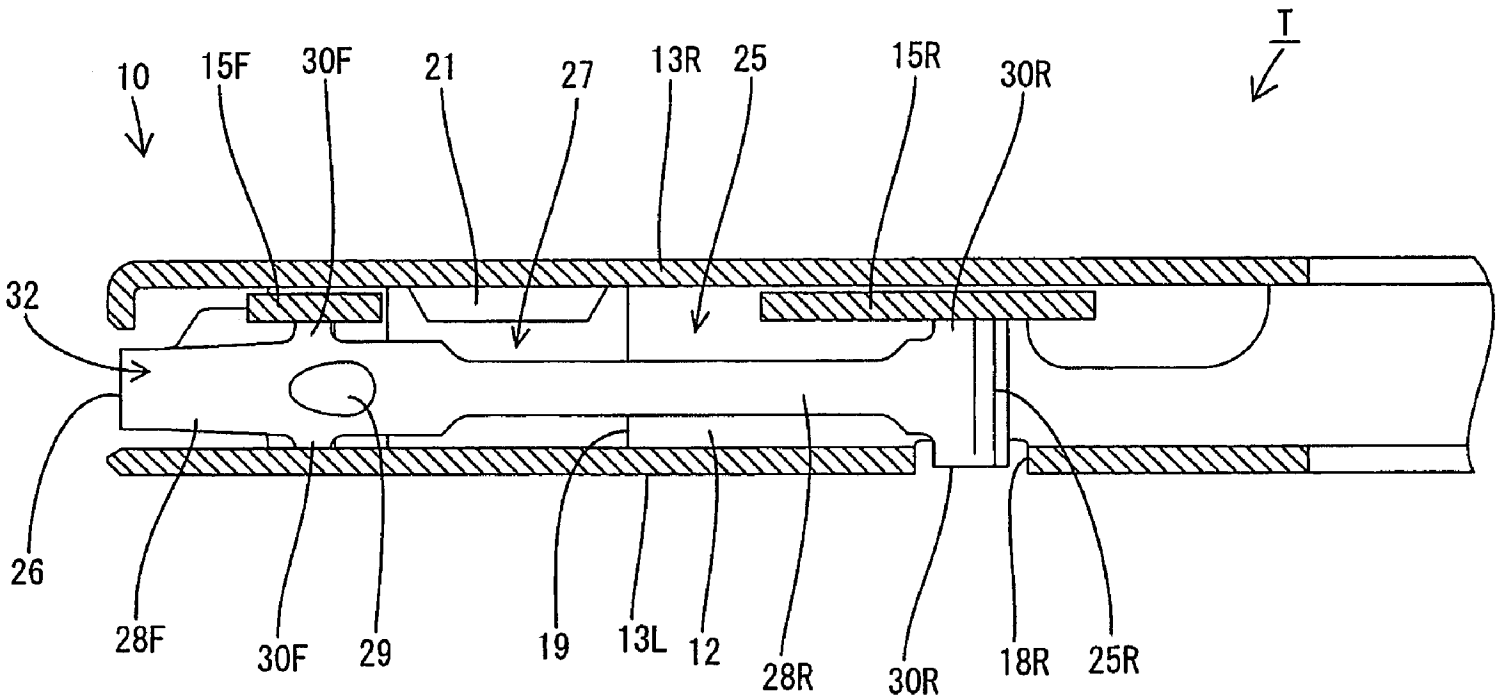
FIG. 6 is a section along 6—6 of FIG. 5.
Figure 7:
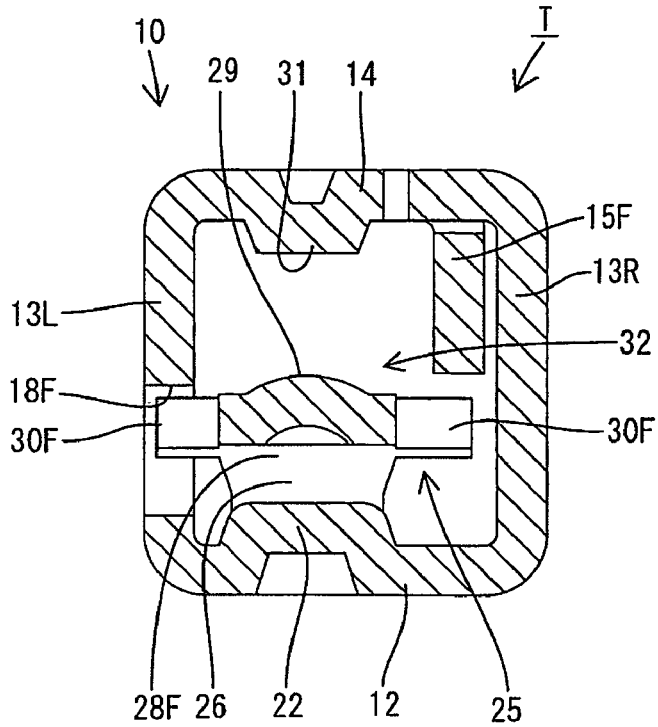
FIG. 7 is a section along 7—7 of FIG. 5.
Figure 8:
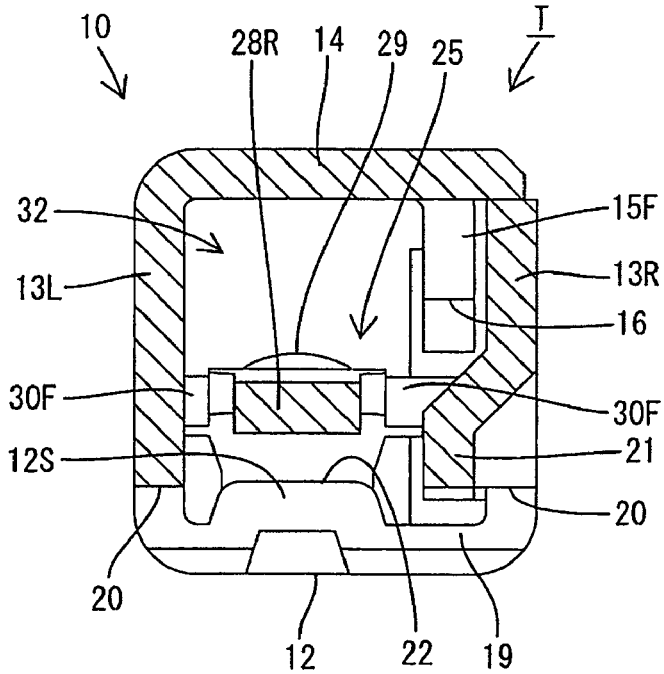
FIG. 8 is a section along 8—8 of FIG. 5.
Figure 9:
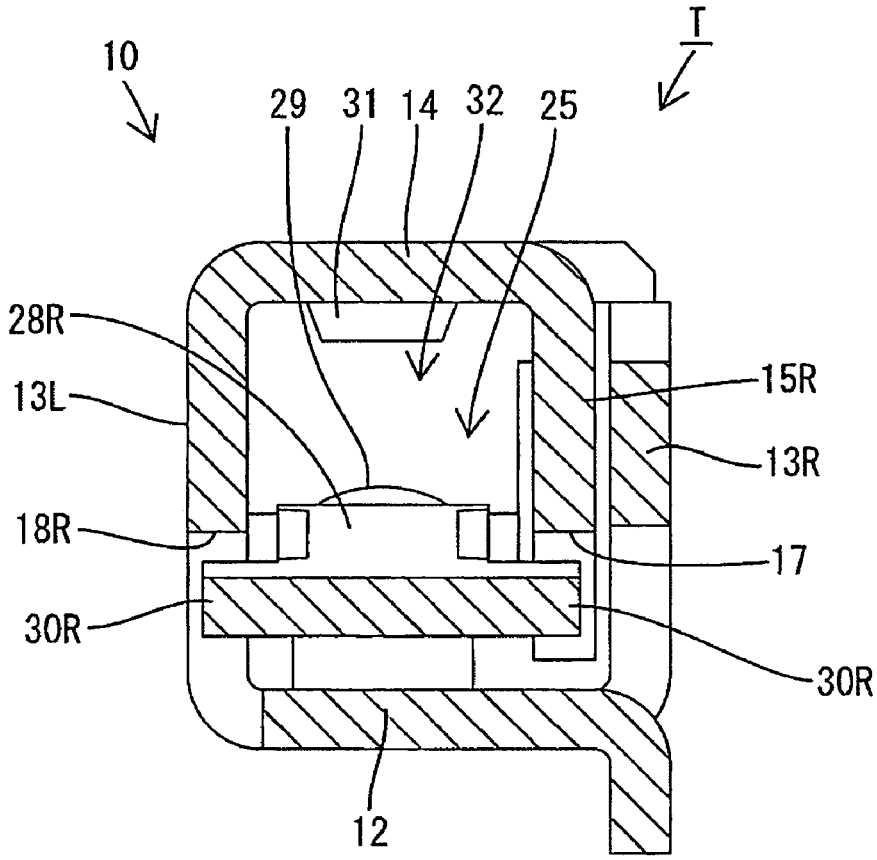
FIG. 9 is a section along 9—9 of FIG. 5.

A resilient contact 25 is accommodated in the rectangular tube 10. As shown in FIG. 5, the resilient contact 25 is long and narrow in forward and backward directions and is bent to cantilever back from the front end of the bottom plate 12. The resilient contact 25 has a substantially semicircular bend 26 connected with the front end of the bottom plate 12, and an extending portion 27 extending back from the bend 26. The extending portion 27 has a forward inclined portion 28F extending obliquely up and to the back from the upper end of the bend 26 and a backward inclined portion 28R extending obliquely down to the back from the rear end of the forward inclined portion 28F. In a free state where the resilient contact 25 is not resiliently deformed, the resilient contact 25 is supported only at its front end since a free end 25R of the resilient contact 25 is located at a non-contact position spaced up from the bottom plate 12. The resilient contact 25 is resiliently deformable substantially up and down in a direction intersecting the forward and backward directions with the bend 26 as a supporting point while mainly resiliently deforming the bend 26. When the resilient contact 25 is deformed down, the free end 25R of the resilient contact 25 contacts the upper surface of the bottom plate 12 so that the resilient contact 25 is supported at both front and rear ends.

The bend 26 and the forward inclined portion 28F are in an area before the locking hole 19, and a substantially dome-shaped contact point 29 projects up at the rear end (i.e. highest part) of the front forward portion 28F. This contact point 29 also is located before the locking hole 19. The backward inclined portion 28R extends in an area from the front edge of the locking hole 19 to the bottom notch 17 of the rear locking plate 15R, and the front end thereof is at a height substantially corresponding to the intrusion restricting portion 21. Further, the widths of the bend 26 and the forward inclined portion 28F are substantially equal; the widths of the front and rear ends of the backward inclined portion 28R are substantially equal to the width of the forward inclined portion 28F; and an area of the backward inclined portion 28R except the front and rear ends thereof is narrower than the forward inclined portion 28F.

Front and rear projections 30F, 30R are formed at each of the left and right edges of the resilient contact 25. The front and rear projections 30F, 30R are substantially flush with the resilient contact 25 in the thickness direction, but bulge outward transversely. The left and right front projections 30F are substantially symmetrical to each other and arranged slightly before the contact point 29. The front projections 30F substantially correspond to the bottom edge of the front locking plate 15F and the front locking hole 18F with respect to forward and backward directions. In the free state, where the resilient contact 25 is not deformed, the upper surface of the right front projection 30F is slightly below the bottom edge of the front locking plate 15F and does not contact the bottom edge, and the upper surface of the left front projection 30F is slightly below the upper edge of the front locking hole 18F and does not contact this upper edge. On the other hand, the rear projections 30R are transversely symmetrical and are close to the free rear end 25R of the resilient contact 25. The rear projections 30R are located to correspond to the upper edge of the bottom notch 17 of the rear locking plate 15R and the rear locking hole 18R with respect to forward and backward directions. In the free state, where the resilient contact 25 is not resiliently deformed, the upper surface of the right rear projection 30R is slightly below the upper edge of the bottom notch 17 and not in contact with this upper edge, and the upper surface of the left rear projection 30R is slightly below the upper edge of the rear locking hole 18R and not in contact with this upper edge.

The resilient contact 25 is substantially transversely symmetrical and displaced to the left along the width direction relative to the rectangular tube 10 and the locking hole 19. The widthwise center of the resilient contact 25 substantially coincides with that of the retaining portion 22. When the locking hole 19 is viewed from below, a front-end area of the backward inclined portion 28R of the resilient contact 25 is exposed over substantially its entire width. The ceiling plate 14 is embossed to project downward, thereby forming a tab receiving portion 31. The widthwise center of the tab receiving portion 31 also substantially coincides with that of the resilient contact 25. A space between the upper surface of the resilient contact 25 and the lower surface of the tab receiving portion 31 serves as the tab entrance space 32 for receiving the tab 54 inserted into the rectangular tube 10 from the front.

The terminal fitting T is inserted into the cavity 51 from behind, with the front plate 43 held at the partial locking position. In the inserting process, the bottom plate 12 of the rectangular tube 10 contacts the retaining projection 52*a* to deform the lock 52 down. The lock 52 resiliently returns up towards the terminal fitting T when the terminal fitting T is inserted to a proper position. As a result, the retaining projection 52*a* enters the locking hole 19 and the front surface of the retaining projection 52*a* engages the retaining portion 22 of the locking hole 19 from behind to retain the terminal fitting T.

The tab 54 can be inserted into the tab entrance space 32 through the tab insertion opening 55 of the front plate 53 from the front and is squeezed resiliently between the tab receiving portion 31 and the contact point 29 while resiliently deforming the resilient contact 25. Thus, the tab 54 and the rectangular tube 10 are connected electrically by a resilient restoring force of the resilient contact 25.

The edge 12S of the retaining portion 22 at the opening of the locking hole 19 in the bottom plate 12 contacts the lock 52 to retain the terminal fitting T. The edge 12S is displaced inwardly of the rectangular tube 10. Thus, a larger engaging margin can be ensured as compared to a case where only the thickness of the plate serves as an engaging margin.

The retaining portion 22 is displaced inwardly of the rectangular tube 10 while the part of the edge 12S of the bottom plate 12 is held substantially faced in a direction to substantially oppose the lock 52, and a boundary between the lower surface of the bottom plate 12 and the edge 12S is well defined angle. Thus, even if an external force acts on the terminal fitting T in withdrawing direction, there is no likelihood that the lock will slip and disengage from the retaining portion as in the case where the boundary between the lower surface of the bottom plate and the end surface is a curve.

If a degree of downward deformation of the resilient contact piece 25 becomes larger than the one in a normal contact state of the resilient contact 25 with the tab 54 when the tab 54 is inserted, a portion of the resilient contact 25 corresponding to the contact point 29 contacts the retaining portion 22 from above and prevents the resilient contact 25 from deforming beyond its resiliency limit. The retaining portion 22 retains the terminal fitting T and also prevents excessive deformation of the resilient contact 25. Thus, the shape of the terminal fitting T can be simplified as compared to a case where an excessive deformation preventing portion for exclusive use is provided in addition to the retaining portion.

External matter that intrudes through the locking hole 19 could push the resilient contact 25 up from below. However, the front projections 30F contact the bottom edge of the front locking plate 15F and the edge of the front locking hole 18F from below, and the rear projections 30R contact the bottom edge of the rear locking plate 15R and the edge of the rear locking hole 18R from below to prevent the resilient contact 25 from being displaced up towards the tab entrance space 32. Further, the locking plates 15F, 15R and the locking holes 18F, 18R are arranged at positions before and behind the locking hole 19. Thus, there is no likelihood that the resilient contact 25 will incline forward and/or backward upon receiving a pushing force from external matter. As a result, the bend 26, which is the supporting point of resilient deformation of the resilient contact 25, will not be deformed plastically.

The front locking plate 15F and the front locking hole 18F located before the locking hole 19 are in the vicinity of the contact point 29 of the resilient contact 25 with the tab 54, even if an area of the resilient contact 25 other than the bend 26 is deformed. Thus, there is no likelihood of changing the position of the contact point 29. Therefore, the resilient contact 25 can contact the tab 54 with a proper contact pressure.

A rear displacement preventing portion (rear locking plate 15R and the rear locking hole 18R) is behind the locking hole 19 and near the free end 25R of the resilient contact 25. Thus, an interval along forward and backward directions between a front displacement preventing portion (front locking plate 15F and front locking hole 18F) and the rear displacement preventing portion (rear locking plate 15R and rear locking hole 18R) is longer than a case where the rear displacement preventing portion is closer to the supporting point of resilient deformation than to the free end. Accordingly, a degree of deformation of the resilient contact 25 when the resilient contact piece 25 is deformed between the front and rear displacement preventing portions by external matter can be suppressed, and the resilient contact 25 is unlikely to deform plastically between the front and rear displacement preventing portions.

The bottom plate 12 has the locking hole 19 for exposing the resilient contact 25 to the outside of the rectangular tube 10, but the right side plate 13R is formed with the intrusion restricting portion 21 close to the resilient contact 25 and located within the opening area of the locking hole 19. Thus, the intrusion of external matter into the locking hole 19 can be restricted by the intrusion restricting portion 21, which in turn prevents the interference of external matter with the resilient contact 25.

The intrusion restricting portion 21 is outside a deformation space for the resilient contact 25 with respect to the width direction. Thus, the interference of the resilient contact 25 and the intrusion restricting portion 21 can be avoided. Accordingly, the contact reliability of the tab 54 and the resilient contact 25 is ensured without hindering the resilient deformation of the resilient contact 25.

The widthwise center of the resilient contact 25 is deviated from that of the rectangular tube 10. This means the presence of a dead space between the resilient contact 25 and the right side plate 13R, which is a side plate more distant from the resilient contact 25. However, the intrusion restricting portion 21 is in this dead space and uses the dead space effectively.

The locking hole 19 is formed over substantially the entire width of the rectangular tube 10 and the exposure of the bottom end surfaces of the left and right side plates 13L, 13R of the rectangular tube 10 in the opening area of the locking hole 19. The bottom end of the right side plate 13R facing the locking hole 19 is embossed to project inward, thereby forming the intrusion restricting portion 21. The stamping or embossing forming method is easily workable as compared to cutting and bending. Therefore, a processing cost can be reduced.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Although the intrusion restricting portion is provided only at one side plate in the foregoing embodiment, it may be provided at both of the lateral (left and right) side plates according to the present invention.

The widthwise center of the resilient contact piece is offset from that of the resilient contact in the foregoing embodiment. However, the widthwise center of the locking hole may substantially coincide with that of a rectangular tube.

The widthwise center of the locking hole substantially coincides with that of the rectangular tube without being offset in the foregoing embodiment. However, the locking hole may be offset from the widthwise center of the tube.

Although the locking hole is formed over substantially the entire width of the rectangular tube in the foregoing embodiment, the present invention is also applicable to cases where the opening width of the locking hole is smaller than the width of the rectangular tube.

Although the intrusion restricting portion is formed by embossing in the foregoing embodiment, it may be formed by cutting and bending.

Although the tube portion according to the above preferably has a substantially rectangular cross-sectional shape it should be understood that the invention is equally applicable to tube portions having other shapes, particularly substantially polygonal (triangular, pentagonal, hexagonal, etc.) shapes and/or substantially round or oval or elliptic shapes.

What is claimed is:

1. A terminal fitting, comprising a tube for receiving a mating contact portion, the tube having opposite top and bottom plates and opposite first and second side plates, a resilient contact extending from one of the top and bottom plates and accommodated in the tube and disposed for contacting the mating contact portion while being resiliently deformed, and a locking hole formed in one of the top and bottom plates of the tube and disposed to at least partly expose the resilient contact externally of the tube, the locking hole being engageable with a resiliently deformable lock of a connector housing, at least one intrusion restricting portion formed by embossing the first side plate inwardly towards the resilient contact and at least partly in an opening area of the locking hole.

2. The terminal fitting of claim 1, wherein the intrusion restricting portion is outside a deformation space for the resilient contact.

3. The terminal fitting of claim 1, wherein the resilient contact has a widthwise center offset from a widthwise center of the tube.

4. The terminal fitting of claim 3, wherein the resilient contact is farther from the first side plate than from the second side plate, the intrusion restricting portion being formed only at the first side plate.

5. The terminal fitting of claim 1, wherein the locking hole is formed over substantially an entire width of the tube.

6. The terminal fitting of claim 1, wherein, end surfaces of the side plates are exposed in the opening area of the locking hole.

7. The terminal fitting of claim 1, wherein the tube has a locking plate, a displacement of the resilient contact (25) towards a portion of the tube is restricted by bringing a portion of the resilient contact into contact with the locking plate.

* * * * *